United States Patent [19]

Stahlecker et al.

[11] Patent Number: 4,672,803

[45] Date of Patent: Jun. 16, 1987

[54] ARRANGEMENT FOR OPEN-END FRICTION SPINNING

[75] Inventors: Fritz Stahlecker, Josef-Neidhart-Strasse 18, 7347 Bad Ueberkingen, Fed. Rep. of Germany; Wolfgang Feuchter, Deggingen, Fed. Rep. of Germany

[73] Assignees: Hans Stahlecker, both of Fed. Rep. of Germany; Fritz Stahlecker, of DEX

[21] Appl. No.: 903,774

[22] Filed: Sep. 4, 1986

[30] Foreign Application Priority Data

Sep. 5, 1985 [DE] Fed. Rep. of Germany ..... 3531627

[51] Int. Cl.[4] ..... D01H 7/885

[52] U.S. Cl. ..... 57/401; 57/301

[58] Field of Search ..... 57/78, 301, 363, 364, 57/400, 401

[56] References Cited

U.S. PATENT DOCUMENTS

| | | | |
|---|---|---|---|
| 4,586,325 | 5/1986 | Wassenhoven | 57/401 X |
| 4,592,198 | 6/1986 | Stahlecker | 57/401 |
| 4,598,539 | 6/1986 | Stahlecker et al. | 57/401 X |
| 4,606,,186 | 8/1986 | Stahlecker | 57/401 |
| 4,612,762 | 9/1986 | Stahlecker | 57/401 X |
| 4,612,763 | 9/1986 | Stahlecker | 57/401 |

*Primary Examiner*—Donald Watkins

*Attorney, Agent, or Firm*—Barnes & Thornburg

[57] ABSTRACT

An arrangement for open-end friction spinning with two rollers forming a wedge-shaped gap is provided for separating the two rollers from a drive during a yarn breakage. A device reduces the speed of the roller rotating into the wedge-shaped gap earlier or faster than the roller rotating out of the wedge-shaped gap. Furthermore, a device is provided for switching off the suction device holding the producing yarn within the wedge-shaped gap during a yarn break.

11 Claims, 2 Drawing Figures

ARRANGEMENT FOR OPEN-END FRICTION SPINNING

BACKGROUND AND SUMMARY OF THE INVENTION

The invention relates to an arrangement for open-end friction spinning with two adjacently arranged friction rollers forming a wedge-shaped gap provided for the yarn formation. The rollers include a drive arrangement which drives the friction rollers in the same rotational direction. A suction device holds the producing yarn within the wedge-shaped gap. Also included is a member which separates the rollers from the drive arrangement which is controlled by a yarn monitor or detector.

In a known arrangement of the above-indicated type, it is left to chance as to how the rollers react upon separation from the drive arrangement such as which roller is delayed faster or stronger and which roller reduces its speed faster.

It is also disclosed in German Published Unexamined Patent Appliction (DE-OS) No. 33 17 368 to provide an intermediary drive in the form of an endless belt for the two rollers in an open-end friction spinning arrangement. The drive action is derived from a continuous tangential belt. This arrangement further provides that upon discontinuance of the operation of the rollers, the tangential belt is separated from the intermediary drive and a brake member of a deflection roller of the intermediary drive is assigned. With this arrangement it is left to chance as to how the two rollers slow down and come to a standstill. In particular, speed differences could occur between the two rollers up until they have come to a standstill. Speed differences could also occur after the separation from the tangential belt, due to elongation of the endless belt of the intermediate drive.

It is also disclosed in commonly assigned U.S. patent application Ser. No. 662,557, filed Oct. 19, 1984 now U.S. Pat. No. 4,612,762, to provide a cleaning device which can shut off the suction into the wedge-shaped gap for a cleaning process. In this patent application, it is also shown to reverse the direction of one of the rollers in order to free the yarn forming region. This is done by providing rollers which engage the friction spinning rollers during the cleaning process after the driving belt has been removed from the friction rollers.

It is an object of this invention to design an arrangement of the kind mentioned above such that the slowing down characteristics of the two rollers upon separation from the drive is controlled in a predetermined manner.

This object is achieved according to the invention by providing means that control the slowing down characteristics of the rollers upon separation from their drive in such a manner that the friction roller rotating into the wedge-shaped gap does not rotate faster, at least in the area of the high rotational speeds, than the roller rotating out of the wedge-shaped gap.

Normally, during a yarn break, yarn or fiber residues remain in the area of the wedge-shaped gap which may no longer be withdrawn after a yarn breakage and which twist themselves together into a so-called yarn cocoon. The danger then exists that the yarn cocoon may be drawn deeper into the wedge-shaped gap and may get jammed in the same. This sort of jamming in turn creates the danger of damage to the surfaces of the rollers and/or their bearings. It was realized with the invention that the yarn cocoon being drawn deeper into the wedge-shaped gap and thereby creating a jamming can be avoided with more certainty if the roller rotating into the wedge-shaped gap does not run faster, even after separation from the drive, than the roller rotating out of the wedge-shaped gap. The danger of jamming of the yarn cocoon within the wedge-shaped gap is especially high if the two rollers still rotate with relatively high speeds, such as at the time immediately following the separation of the rollers from the drive. In most cases it will therefore be sufficient to limit the control of the slowing down characteristics of the rollers in the range of relative high speeds according to certain preferred embodiments of the invention.

In a further development of preferred embodiments of the invention, it is provided that the two friction rollers are connected with each other by way of a synchronizing means at least immediately upon separation from the drive. In this manner it is more certainly guaranteed that the roller rotating into the wedge-shaped gap does not rotate faster than the roller rotating out of the wedge-shaped gap during the slowing down period.

In another development of preferred embodiments of the invention, means are provided for reducing the speed of, or bringing to a standstill, the roller that rotates out of the wedge-shaped gap, subsequent to reducing the speed of or bringing the roller that rotates into the wedge-shaped gap to a standstill.

In a further development of certain preferred embodiments of the invention, means are provided for switching off the suction device. Thereby it is preferably provided to control the means for switching off the suction device by the yarn detector or monitor. Therefore the air streams or currents are switched off which hold the yarn cocoon in the area of the wedge-shaped gap so that the cocoon can easily be removed from the area of the wedge-shaped gap.

Further objects, features, and advantages of the present invention will become more apparent from the following description when taken with the accompanying drawings which shows, for purposes of illustration only, several embodiments constructed in accordance with the present invention.

DETAILED DESCRIPTION OF THE DRAWINGS

Figure 1:
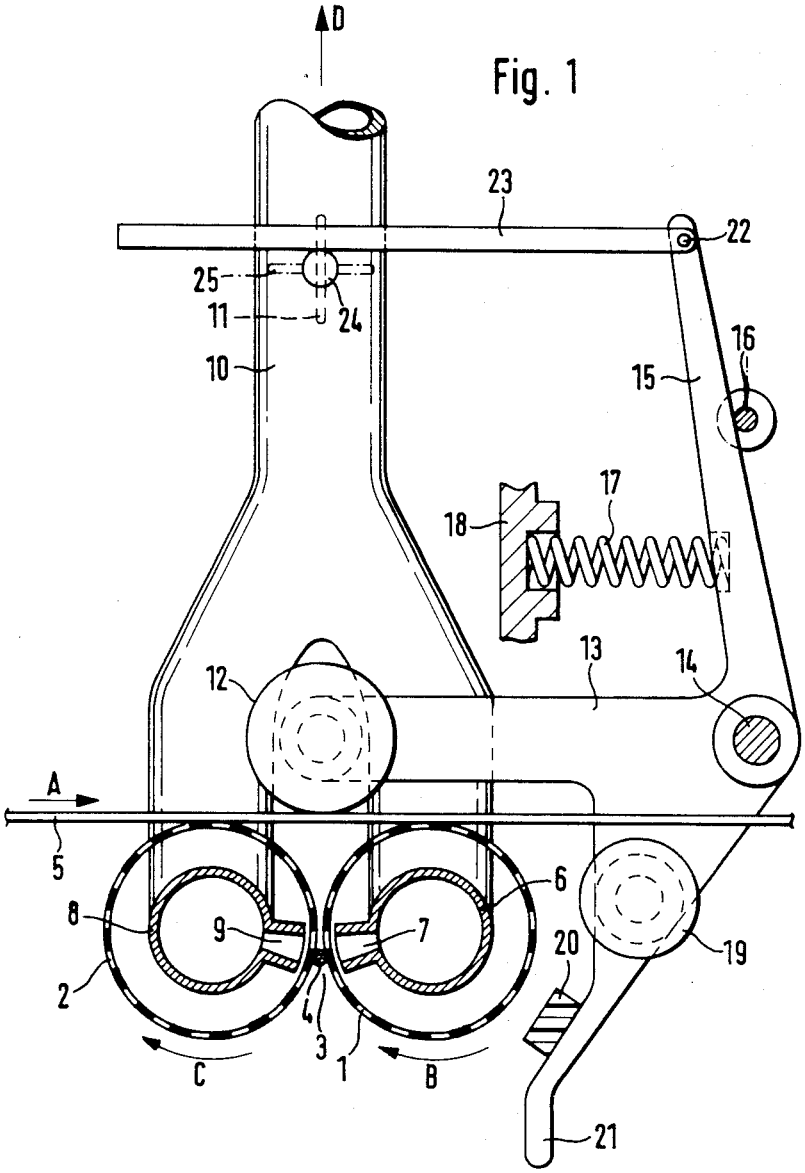
FIG. 1 is a schematic partial view of an arrangement for open-end friction spinning with a device for braking the roller rotating into the wedge-shaped gap upon interruption of the drive of the rollers, constructed in accordance with a preferred embodiments of the invention.

FIG. 1 only shows the parts of an arrangement for open-end friction spinning necessary for the understanding of the invention. The shown arrangement is an integral part of a spinning machine containing a plurality of such devices which are arranged adjacent to each other in a row on one or both sides of the machine.

The arrangement shown in FIG. 1 includes two rollers 1 and 2, which are driven in the same rotational direction depicted by arrows B and C by a tangential belt 5 directly contacting their shells. The tangential belt 5 running in arrow direction A drives the rollers 1 and 2 of all devices of at least one side of the machine. Roller 1 thereby rotates into the wedge-shaped gap, in which a yarn 4 is formed. Roller 2, on the other hand, rotates out of the wedge-shaped gap 3.

The rollers 1 and 2 are designed as so-called suction rollers. They contain in their interior a suction pipe 6 and 8 respectively connected via a common suction channel 10 to a subpressure or vacuum source not shown here. The suction pipes 6 and 8 are respectively provided with a suction slot 7 and 9 directed towards the area of the wedge-shaped gap 3. The air stream or current D produced in the suction channel 10 is sucked through the perforated shell surfaces of rollers 1 and 2 via the two suction slots 7 and 9.

The tangential belt 5 is pressed against the shells of rollers 1 and 2 by a tensioning roller 12 which is arranged in the plane of the wedge-shaped gap 3. The tensioning roller 12 is arranged upon a lever arm 13 pivotable about a stationary axle 14. The lever arm 13 is stationarily connected to another lever arm 15 which contacts a stop 16 by means of a pressure spring 17. The stop 16 determines the operating position of the tensioning roller 12. The pressure spring 17 is supported against a stationary component element 18 of the machine.

The stop 16 is a controllable component part arranged with an operating member which in turn is controlled by a yarn detector or monitor arranged in a not further described manner in the yarn path between the wedge-shaped gap 3 of rollers 1 and 2 on the one hand, and a spooling device on the other hand. In this embodiment, the stop 16 comprises a needle of a piston magnet controlled by the yarn detector or monitor such that the needle is moved away from the lever arm 15 during a yarn break. The pressure spring 17 then swiftly moves the lever arm 15 and thereby also the lever arm 13 and the tensioning roller 12 beyond the tangential belt 5. The drive of rollers 1 and 2 is thereby interrupted.

In addition to controlling the interruption of the drive of rollers 1 and 2, the slowing down characteristic of rollers 1 and 2 is also controlled such that roller 1 rotating into the wedge-shaped gap 3 never rotates faster than the roller 2 rotating out of the wedge-shaped gap 3, especially immediately following the separation of the drive from the rollers and the thereby still existing high speeds. Roller 1 is assigned a brake means 20 which is put in position simultaneously with the separation of the drive of roller 1. The brake 20 is positioned upon a lever arm 21 which is stationarily connected with the lever arms 13 and 15 and is pivotable also about the axle 14. Lever arm 21 additionally carries a lift-up roller 19 which moves toward the tangential belt 5 from the sides of rollers 1 and 2 during a swivelling of the lever arm 15 and during the resulting lifting off of the tensioning roller 12. The tangential belt 5 is thereby lifted up from rollers 1 and 2 while at the same time the braking surface 20 contacts against roller 1.

While only roller 1 is then slowed down and roller 2 rotates freely, it is thereby accomplished that the yarn cocoon still remaining after a yarn break within the wedge-shaped gap 3 is not drawn deeper into same. On the contrary, it is thereby assured that roller 2 acts to move the yarn cocoon in a direction out of the wedge-shaped gap 3.

In order to ease the removal of the yarn cocoon out of the wedge-shaped gap 3 during a yarn break, it is further provided to switch off the suction device simultaneously with the interruption of the drive of rollers 1 and 2 and the braking action of roller 1. A leaf or flap valve 11 is therefore arranged in the suction channel 10 which moves into locking position (dash dotted position 25) with the occurrence of a yarn break. A steering rack 23 is attached at the level arm 15 via a joint 22 which engages with a pinion gear 24 stationarily connected to the axle of the leaf valve 11.

Figure 2:
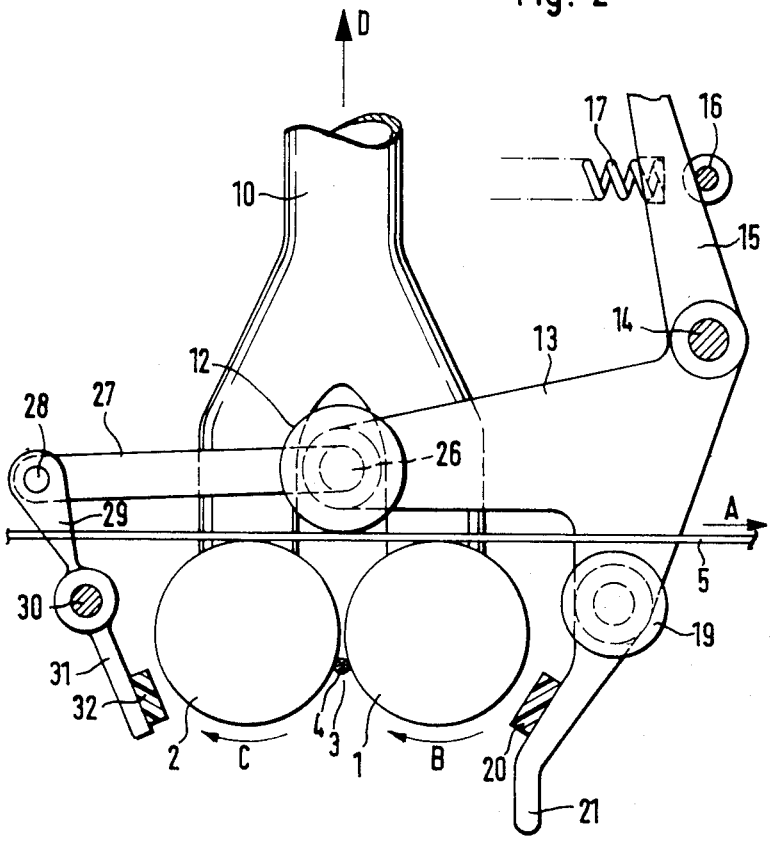
FIG. 2 is a schematic view of an arrangement for open-end friction spinning whereby both rollers are slowed down in a time interval upon interruption of the drive constructed in accordance with another preferred embodiment of the invention.

In the embodiment according to FIG. 2, the same component parts are essentially used as the embodiment according to FIG. 1 and corresponding reference numerals are applied as with the embodiment according to FIG. 1. Consequently, a repetitious description in connection with FIG. 2 is not included and only those differences from FIG. 1 are discussed that are deemed necessary to an understanding of this FIG. 2 embodiment.

In addition to the embodiment according to FIG. 1, the embodiment according to FIG. 2 is also provided with means for braking roller 2 rotating out of the wedge-shaped gap 3 during a yarn break. A pulling lever 27 is coupled to lever arm 13 which is connected via a joint 28 to a two-armed lever 29, 31 . The two-armed lever 29, 31 is pivotable about a stationary axle 30. Lever 29, 31 carries a breaking liner 32 at its free end that is movable to the shell surface of roller 2. The dimensions of lever arms 13, 15 and 21, as well as the dimensions of the intermediate lever 27 and two-armed lever 29 and 31 are chosen in such a manner that the brake liner 20 first contacts roller 1 and subsequently thereto brake liner 32 contacts roller 2 with a time delay. A time delay in the operation of brakes 20, 32 is thereby accomplished such that the braking action or effect for roller 2 occurs in a time delayed manner. It is thereby sufficient to accomplish the different braking effects or actions only in the range of the still high rotational speeds since the danger that the yarn cocoon is drawn into the wedge-shaped gap 3 and leads to a jamming thereof is especially high under these circumstances.

In a modified embodiment, the lever arms are so constructed that the tangential belt 5 is first lifted off of roller 1 rotating into the wedge-shaped gap 3 via the lift-off roller 19 such that at this point in time roller 2 is still driven. In this situation it is possible to then activate the braking simultaneously and/or also with the same force since during the separation of the drive from rollers 1 and 2, the desired slowing down characteristic had already been obtained.

With another not further illustrated embodiment it is provided to connect the two rollers 1 and 2 to each other by means of a synchronizing element, for example, by means of an elastic, endless belt. This synchronization element serves additionally to insure that no unfavorable speed relationship between rollers 1 and 2 will occur during an interruption of the drive.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Apparatus for open-end friction spinning comprising:

a pair of adjacently arranged friction rollers forming a wedge-shaped yarn forming gap therebetween;

roller driving means for driving the rollers in the same rotational direction;

holding force means for applying holding forces to hold the forming yarn and supplied fibers in the wedge-shaped gap; and separating means for separating the rollers from said roller driving means after yarn breakage, said separating means being controlled by a yarn monitor and including means insuring that the roller which normally rotates into the wedge-shaped gap during its deceleration has a rotational speed which at least at high rotational speeds does not exceed the speed of the other roller.

2. Apparatus according to claim 1, wherein the two rollers are connected to each other at least upon separation from the drive by way of synchronizing element means.

3. Apparatus according to claim 1, wherein the separating means includes speed reducing means for reducing the speed of the roller rotating into the wedge-shaped gap or to bring the same to a standstill in time prior to roller rotating out of the wedge-shaped gap.

4. Apparatus according to claim 1, wherein the separating means includes influencing means for influencing the slowing down characteristics for at least one of the rollers.

5. Apparatus according to claim 4, wherein the influencing means includes braking means for braking the roller rotating into the wedge-shaped gap.

6. Apparatus according to claim 4, wherein the influencing means includes braking means for braking both rollers whereby the means for braking the roller rotating into the wedge-shaped gap are designed to at least create a greater braking effect in the beginning of the braking process than the means for braking the roller rotating out of the wedge-shaped gap.

7. Apparatus according to claim 1, wherein the holding force means comprises suction device means for applying suction forces to the yarn forming gap and wherein means are provided for switching off the suction device means after a yarn breakage.

8. Apparatus according to claim 7, wherein the means for switching off the suction device are controlled by a yarn monitor.

9. Apparatus according to claim 1, wherein said separating means includes a brake means actuable on said inwardly rotating roller separate from the other roller.

10. Apparatus according to claim 2, wherein the synchronizing element means is an endless belt.

11. Apparatus according to claim 10, wherein said separating means includes a brake means actuable on said inwardly rotating roller separate from the other roller.

* * * * *